US006167861B1

(12) United States Patent
Kouchi et al.

(10) Patent No.: US 6,167,861 B1
(45) Date of Patent: Jan. 2, 2001

(54) MOUNTING CONFIGURATION FOR THE EXHAUST PIPE COVER OF AN ENGINE

(75) Inventors: Hiroyoshi Kouchi; Kazuyuki Kobayashi; Shogo Nakamura, all of Nagoya (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/236,400

(22) Filed: Jan. 25, 1999

(30) Foreign Application Priority Data

Jan. 27, 1998 (JP) ..... 10-029176

(51) Int. Cl.[7] ..... F02F 7/00

(52) U.S. Cl. ..... 123/195 C; 123/198 E

(58) Field of Search ..... 123/195 C, 198 E

(56) References Cited

FOREIGN PATENT DOCUMENTS

| | | |
|---|---|---|
| 60-14224 U | 1/1985 | (JP) . |
| 62-185833 U | 11/1987 | (JP) . |
| 3-61538 U | 2/1993 | (JP) . |
| 70-63037 | 3/1995 | (JP) . |

*Primary Examiner*—Noah P. Kamen
(74) *Attorney, Agent, or Firm*—Evenson, McKeown, Edwards & Lenahan, P.L.L.C.

(57) ABSTRACT

In a mounting configuration for an exhaust pipe cover of an engine in which a muffler is affixed to an outlet flange of an exhaust pipe whose inlet flange is connected to an exhaust outlet of a cylinder head of the engine, the exhaust pipe cover which shields the exhaust pipe is affixed with a bottom of the muffler to the outlet flange of the exhaust pipe. An upper flange of the exhaust pipe cover is affixed to both the bottom of the muffler and the outlet flange of the exhaust pipe, and a front portion of the exhaust pipe cover extends downward from the upper flange in such a way as to cover the exhaust pipe.

4 Claims, 3 Drawing Sheets

MOUNTING CONFIGURATION FOR THE EXHAUST PIPE COVER OF AN ENGINE

FIELD OF THE INVENTION

This invention concerns a mounting configuration for an exterior insulating cover for the exhaust pipe on a small multipurpose single-cylinder engine.

BACKGROUND OF THE INVENTION

In recent years small multipurpose engines have been improved by being made lighter in overall weight and more compact to the point where they can be picked up and carried in one's hands. At the same time, various designs have been proposed for the insulating cover for the exhaust pipe, which becomes extremely hot when the engine is running.

In the prior art, such exhaust pipe covers were mounted to the engine using the following configurations.

(1) When the exhaust pipe was made from steel tubing

The cover was welded to the exhaust pipe to form an integral structure or the mounting fittings were welded to the pipe and the cover was fixed to the fittings by means of bolts or some similar hardware so that there was a gap between the cover and the pipe.

(2) When the exhaust pipe was made of cast iron

A mounting seat was provided on the engine cylinder, the cylinder head or the exhaust pipe. The cover was fixed to this mounting seat by means of bolts or some similar hardware with a gap between the pipe and the cover.

A practical example of the mounting configuration for such an exhaust pipe cover may be found in Patent Report 62-185833. In this design, three shrouds are used: an upper shroud to cover the muffler; a lower shroud to cover the cylinder; and a lateral shroud (the exhaust pipe cover) to cover the exhaust pipe. The lower portion of the exhaust pipe cover is attached to the engine by bolts which also secure the lower shroud.

The parts of the engine which reach high temperatures, such as the cylinder head and the exhaust pipe, need to be shielded by protective covers so that the person using the engine will not be burned if he touches them. For small multipurpose engines in particular, the number of fittings must be kept low, and the fittings must be able to be mounted and removed simply in a small number of assembly processes. The construction of the fittings also must be simple, and they must be able to be made in a small number of manufacturing processes.

However, with the prior art techniques listed above, the exhaust pipe cover is either welded to the exhaust pipe or attached to it by means of a specialized bolt exclusively used for the exhaust pipe cover. This means that the cover, too, is likely to reach easily a high temperature, and its essential insulating function is compromised.

Also, the techniques described above require specialized components such as mounting fittings, which pushes the parts count upward. The process of manufacturing the mounting seat also increases the number of production processes.

Like the prior art techniques, the design disclosed in Japanese Utility Patent Publication (Kokai) 62-185833, also requires specialized components such as bolts to mount the exhaust pipe cover, which are exclusively used for mounting the pipe, and result in driving up the parts count. In addition to this disadvantage, the lower portion of the cover is fixed to the lower shroud, which is made of an insubstantial plate. The cover, then, is not securely supported, which can result in vibration and noise.

SUMMARY OF THE INVENTION

In view of these problems in the prior art, the object of this invention is to provide a mounting configuration for an exhaust pipe cover which reduces the parts count, reduces the number of production and assembly processes and lowers the cost. Such a configuration would reliably insulate the exhaust pipe without resulting in vibration and would provide a secure mounting for the cover.

To achieve these objects, the present invention provides a mounting configuration for the cover of an engine exhaust pipe which is distinguished by the following characteristics. This invention concerns the exhaust pipe of an engine in which a muffler is affixed to the outlet flange of an exhaust pipe whose inlet flange is connected to the exhaust outlet of the cylinder head. The cover which shields the exhaust pipe is affixed by the same means to the outlet flange of the pipe and to the bottom of the muffler together.

The upper flange of the exhaust pipe cover is affixed to both the bottom of the muffler and the outlet flange of the exhaust pipe together. Its front portion extends downward from the upper flange in such a way as to cover the exhaust pipe.

The exhaust pipe cover is made from a thin metal plate. The bolts securing the outlet flange of the exhaust pipe, which extends downward from the bottom of the muffler, hold fast both the bottom of the muffler and the outlet flange.

The upper flange of the exhaust pipe cover is virtually horizontal, and its front surface is virtually vertical. To enhance the structural integrity of the cover, ribs are provided which extend from the upper flange down the front surface.

According to this invention, the exhaust pipe cover is affixed to the bottom of the muffler and to the outlet flange of the exhaust pipe using the bolts that secure them to the engine body. No specialized hardware is, therefore, needed, so fewer parts are required than in prior art engines.

No special process is needed to mount the exhaust pipe cover. This reduces the number of manufacturing processes. The cover is easier to mount and remove, and the number of assembly processes is reduced.

As has been discussed earlier, the exhaust pipe cover is affixed to the rigid outlet flange of the exhaust pipe by the same means (bolts) that fasten it to the bottom of the muffler. This design assures that the cover is mounted securely and prevents the occurrence of vibration or noise. Furthermore, the upper flange of the exhaust pipe cover is securely affixed to both the outlet flange of the exhaust pipe and the muffler. This means that a large insulation distance can be maintained between the cover and the pipe, and that the contacting area of the cover receiving direct heat is small. As a result, the temperature of the cover can be kept relatively low, which improves the safety of the engine.

DETAILED DESCRIPTION OF THE INVENTION

In this section a detailed explanation of the invention will be given with reference to the drawings, using preferred embodiments for the purpose of illustration. To the extent that the dimensions, materials, shape and relative position of the components described in these embodiments need not be definitely fixed, the scope of the invention is not limited to the embodiments as described herein, which are meant to serve merely as examples.

Figure 1:
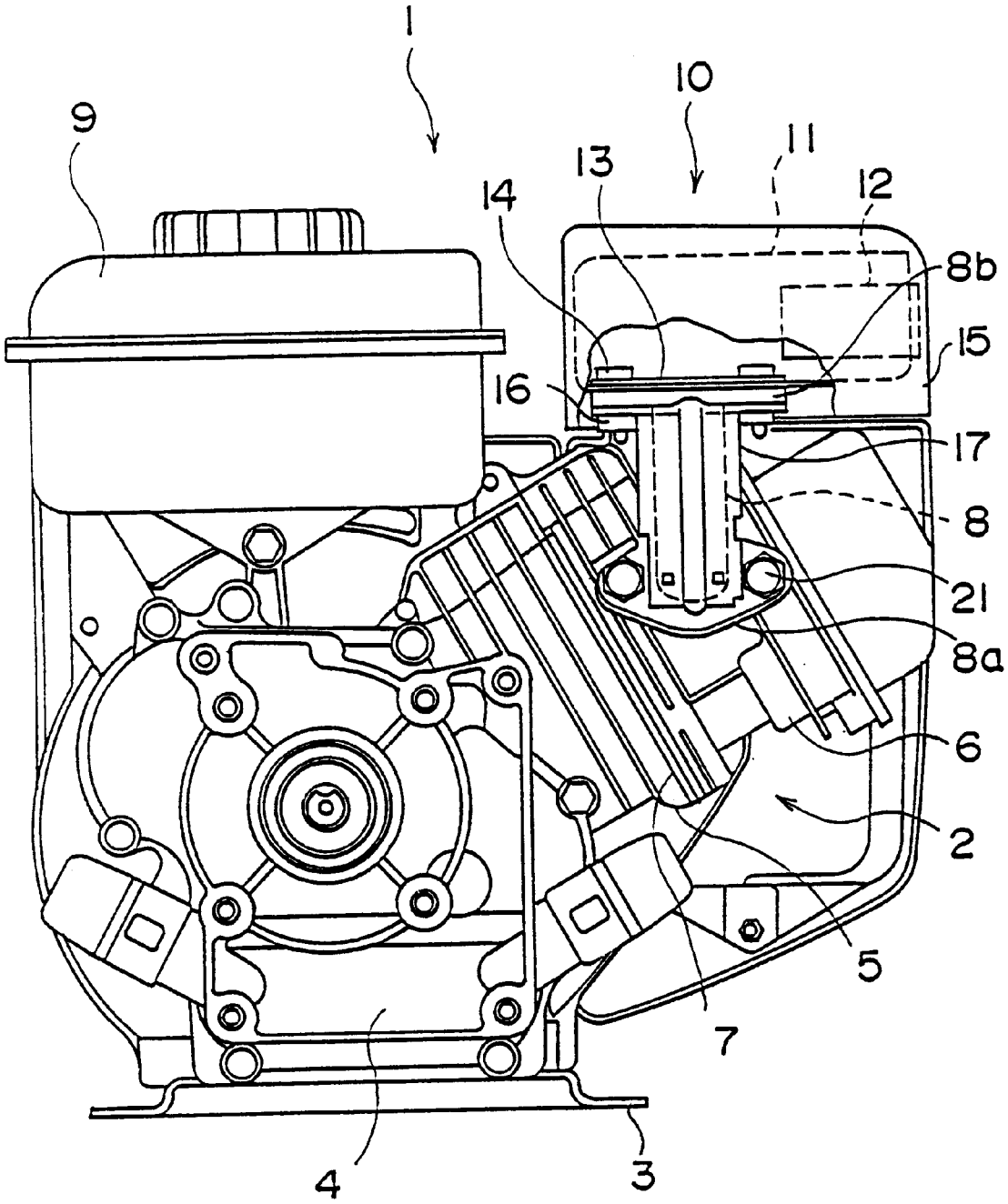
FIG. 1 is a frontal view of an engine in which the mounting configuration used is an ideal embodiment of this invention.
Figure 2:
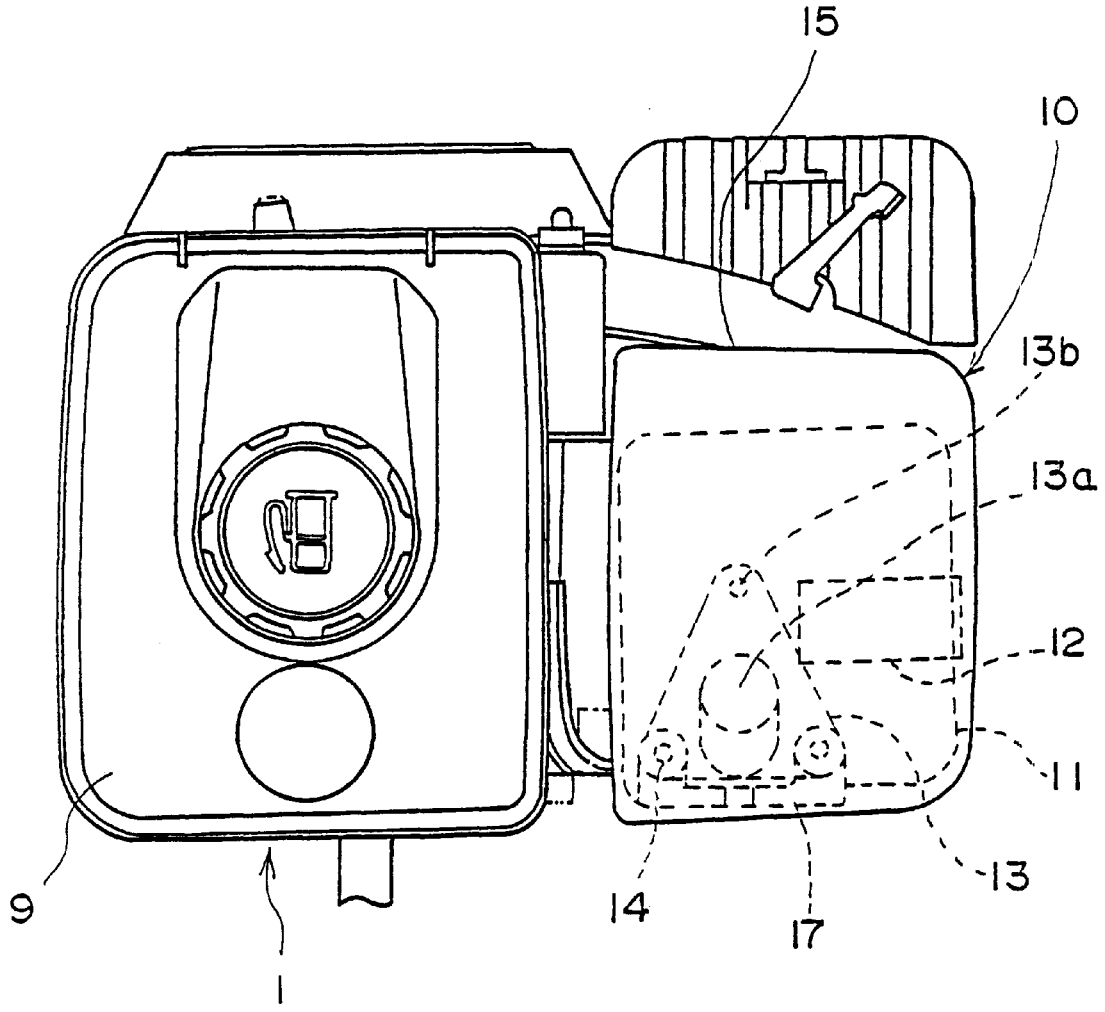
FIG. 2 is a plan view of the engine in FIG. 1.
Figure 3:
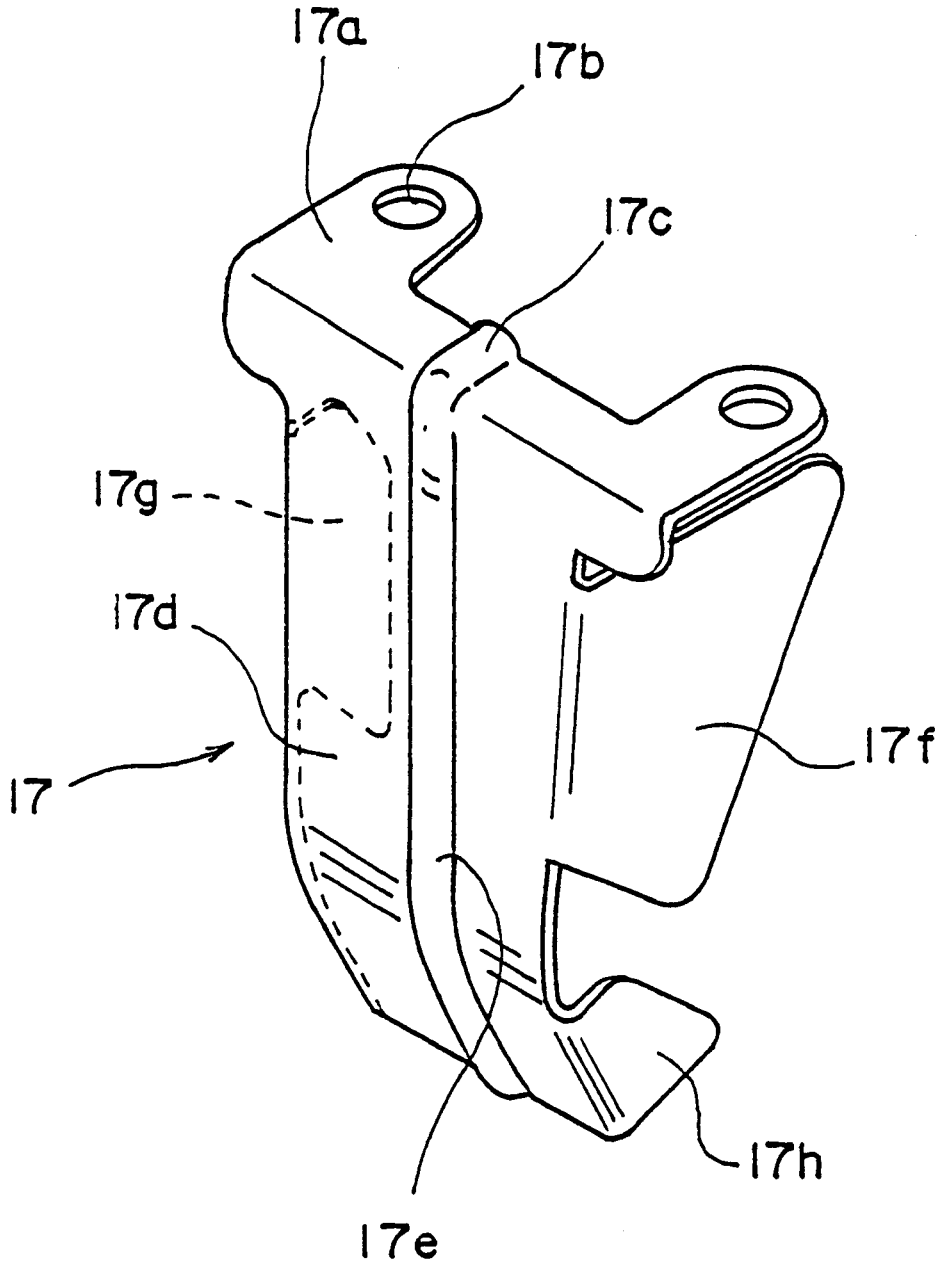
FIG. 3 is a perspective drawing of the exterior of an exhaust pipe cover related to the ideal embodiment of this invention.

FIG. 1 is a front view of a small multipurpose single-cylinder engine which is a preferred embodiment of this invention. FIG. 2 is a plan view of this engine. FIG. 3 is a perspective drawing of the exterior of its exhaust pipe cover.

In FIGS. 1 and 2, 1 is the engine, a single-cylinder engine in which the cylinder is canted upward. 2 is the engine body, which is seated on and fixed to stage 3. It comprises primarily crankcase 4, cylinder 5 and its cooling fan 7, both canted upward, and cylinder head 6, which is mounted on top of the cylinder 5.

Fuel tank 9 is located above the crankcase 4, and muffler 10 is located above the cylinder head 6. The muffler 10 comprises primarily muffler body 11, which is made from metal sheeting; tailpipe 12, which is attached to the muffler body 11; inner panel 13; and welded bolts 14. Insulating cover 15 is placed on the exterior of the muffler body 11 in such a way that it covers muffler body 11. The inner panel 13, as can be seen in FIG. 2, is triangular in shape. In the center of the panel is an opening 13*a,* and three bolt holes 13*b* are provided in the corners of the panel. This panel is affixed to the bottom of muffler body 11 along with welded bolts 14.

8 is a cast iron exhaust pipe. From inlet flange 8*a* on its lower end it slants upward (toward the viewer in FIG. 1) and then bends so that its upper end is virtually perpendicular. There is an outlet flange 8*b* on its upper end. The inlet flange 8*a* is diamond-shaped and has bolt holes on either end. Like the inner panel 13, outlet flange 8*b* is triangular and has three bolt holes. The inlet flange 8*a* is affixed, together with a gasket, to the exhaust port (not pictured) of the cylinder head 6 by bolts 21. The outlet flange 8*b* is affixed, together with a gasket, onto the bottom of muffler body 11 by bolts 14, which protrude from the bottom of the muffler body so that they can also mount exhaust pipe cover 17; they are immobilized by nuts 16.

17 is the exhaust pipe cover. As can be seen in FIG. 3, the cover 17 is made from a light-weight sheet metal. Its horizontal upper flange 17*a* is shaped like an angular letter "C" and has two bolt holes 17*b*.

The upper flange 17*a,* as stated above, is shaped like the letter "C" in order to prevent it from interfering with exhaust pipe 8 or its outlet flange 8*b*.

The front portion 17*d* of exhaust pipe cover 17 extends downward from the upper flange 17*a*. 17*c* and 17*e* identify a structural rib with a semicircular cross section which extends from the upper flange 17*a* down the center of the front surface 17*d*.

As described above, the front surface 17*d* of the exhaust pipe cover 17 is orthogonal to upper flange 17*a*. Its lower portion is bent at an angle which follows the curve of exhaust pipe 8. Lateral panels 17*f,* 17*g* and 17*h* are formed integrally with the front surface 17*d* and are orthogonal to it. They are shaped in such a way that they will not interfere with cylinder head 6 or exhaust pipe 8.

As explained above, in this engine the upper flange 17*a* of exhaust pipe cover 17 is affixed by bolts 14, namely the mounting bolts for exhaust pipe 8, to both outlet flange 8*b* and inner panel 13 on the bottom of muffler 10. Thus no special fittings are needed to mount exhaust pipe cover 17. The parts count is significantly lower than in engines of the prior art. No special process is required to mount cover 17, and it can be mounted and removed in a simple manner. Furthermore, exhaust pipe cover 17 is affixed to the bottom of muffler 10 as well as to outlet flange 8*b* of the exhaust pipe, a portion of the pipe with considerable rigidity. This assures a secure mounting configuration and prevents the occurrence of vibration or noise.

Exhaust pipe cover 17 is made from thin sheet metal and is affixed to the pipe only at upper flange 17*a*. This arrangement allows there to be a large insulating distance between cover 17 and the hot exhaust pipe 8. Only a small portion of the surface of cover 17 is heated by contact, while the area of the surface capable of radiating heat can be kept large. The surface will remain cool, and the safety of the engine will be improved.

As discussed above, with this invention the exhaust pipe cover is affixed to the outlet flange of the exhaust pipe as well as to the bottom of the muffler, using the bolts for the outlet flange. Thus no special fittings are needed to mount the exhaust pipe cover. The parts count is significantly lower than in engines of the prior art. No special process is required to mount the cover, and it can be mounted and removed in a simple manner. The number of assembly processes is also reduced. The overall weight of the engine is reduced, and its cost is lower.

Furthermore, the upper flange of the exhaust pipe cover is affixed to both the exhaust pipe and to the muffler. This allows there to be a large insulating distance between the cover and the pipe. Only a small portion of the cover is heated by contact, so its temperature can be kept lower, and its safety improved.

Since the cover is mounted to the outlet flange of the exhaust pipe, a portion of the pipe with considerable rigidity, no vibration or noise occurs.

We claim:

1. A mounting configuration for an exhaust pipe cover of an engine in which a muffler is affixed to an outlet flange of an exhaust pipe whose inlet flange is connected to an exhaust outlet of a cylinder head of said engine, wherein said exhaust pipe cover, which shields said exhaust pipe, is affixed together with a bottom of said muffler to said outlet flange of said exhaust pipe.

2. A mounting configuration for an exhaust pipe cover of an engine according to claim 1, wherein an upper flange of said exhaust pipe cover is affixed to both the bottom of said muffler and the outlet flange of said exhaust pipe, and a front portion of said exhaust pipe cover extends downward from said upper flange in such a way as to cover said exhaust pipe.

3. A mounting configuration for an exhaust pipe cover of an engine according to claim 2, wherein said exhaust pipe cover is made from a thin metal plate, and bolts securing said outlet flange of said exhaust pipe, which extend downward from the bottom of said muffler, hold fast said exhaust pipe cover to both the bottom of said muffler and said outlet flange.

4. A mounting configuration for an exhaust pipe cover of an engine according to claim 3, wherein said upper flange of said exhaust pipe cover is virtually horizontal, said front portion of said exhaust pipe cover is virtually vertical, and a rib is provided which extends from said upper flange down said front surface to enhance structural integrity of said exhaust pipe cover.

* * * * *